United States Patent [19]

Lin et al.

[11] Patent Number: 4,596,613

[45] Date of Patent: Jun. 24, 1986

[54] METHOD FOR TREATING CAST AMORPHOUS METAL STRIP MATERIAL

[75] Inventors: Kou C. Lin, Hermitage; Charles E. Burkhardt, Sharon, both of Pa.

[73] Assignee: Electric Power Research Institute, Inc., Palo Alto, Calif.

[21] Appl. No.: 568,539

[22] Filed: Jan. 5, 1984

[51] Int. Cl.[4] ..... H01F 1/00

[52] U.S. Cl. ..... 148/20.3; 148/122; 148/131; 148/403

[58] Field of Search ..... 148/122, 131, 20.3

[56] References Cited

U.S. PATENT DOCUMENTS

| | | | |
|---|---|---|---|
| 2,655,717 | 10/1953 | Dunn | 29/155.58 |
| 4,053,331 | 10/1977 | Graham et al. | 148/120 |
| 4,053,332 | 10/1977 | Egami et al. | 148/120 |
| 4,053,333 | 10/1977 | Egami et al. | 148/131 |
| 4,284,441 | 8/1981 | Satoh et al. | 148/120 |
| 4,288,260 | 9/1981 | Senno et al. | 148/121 |
| 4,444,602 | 4/1984 | Makino et al. | 148/121 |

*Primary Examiner*—Melvyn J. Andrews

*Attorney, Agent, or Firm*—Flehr, Hohbach, Test, Albritton & Herbert

[57] ABSTRACT

A method for treating cast amorphous metal strip material. The method comprises heating a cast amorphous metal strip to a temperature of approximately 250° in a non-oxidizing atmosphere, thereafter removing the cast amorphous strip from that atmosphere, and applying a tensile force to the strip material to eliminate elastic buckling therefrom.

11 Claims, 2 Drawing Figures

METHOD FOR TREATING CAST AMORPHOUS METAL STRIP MATERIAL

The present invention relates generally to the use of amorphous metal strip material for fabricating magnetic cores, and more particularly to a method of treating cast amorphous metal strip material prior to using it in a magnetic core.

Electrical induction apparatus, such as transformers and like, are constructed of cores of magnetic material to provide a path for magnetic flux. Such cores may be fabricated from a magnetic strip material having a preferred direction of orientation parallel to the longitudinal direction of the material, for example, a non-amorphous material such as grain-oriented steel.

Magnetic cores may also be made from amorphous metal strip material, for example, METGLAS® amorphous metal strip material manufactured by the Allied Corporation (METGLAS® is a registered trademark for Allied Corporation's amorphous metal alloys). The amorphous metal strip material has lower core loss characteristics than non-amorphous material. However, the amorphous strip material is very thin, brittle and hard, and as such presents problems in core fabrication.

The physical appearance of a cast amorphous metal strip material is generally poorer than that of a non-amorphous material such as rolled grain-oriented silicon iron. When a sample of cast amorphous metal strip material is positioned along an 85° or 90° tilted steel plate or is laid horizontally on a flat plate, the material exhibits ripples or dimples along its length. Such surface imperfections are caused by elastic buckling produced during casting of the molten amorphous metal. It has been found that surface imperfections in amorphous strip material adversely effect true watt loss and the exciting power of a core, and that such effects are more pronounced in a stacked core than in a round core.

Accordingly, an object of the present invention is to provide a method which removes surface imperfections from cast amorphous strip material prior to use of the material for core processing.

In accordance with the method of the present invention, cast amorphous metal strip material is heated to a temperature of approximately 250° in a special, non-oxidizing atmosphere. The material is then removed from this atmosphere and a tensile force is applied to the material to eliminate elastic buckling therefrom.

Figure 1:
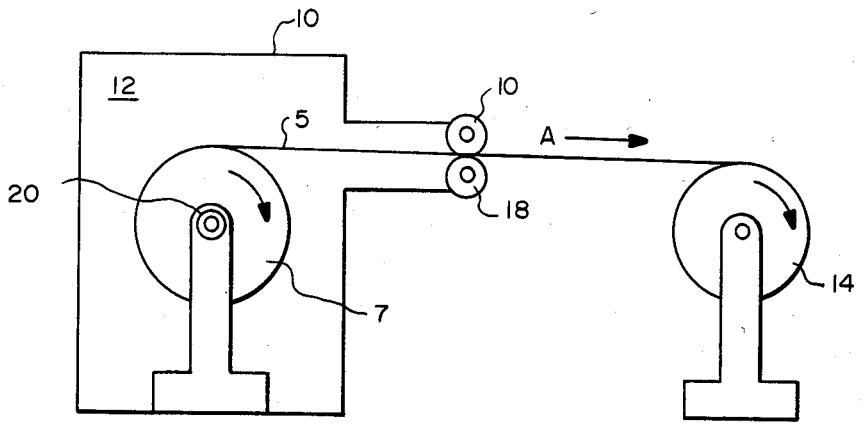
Figure 2:
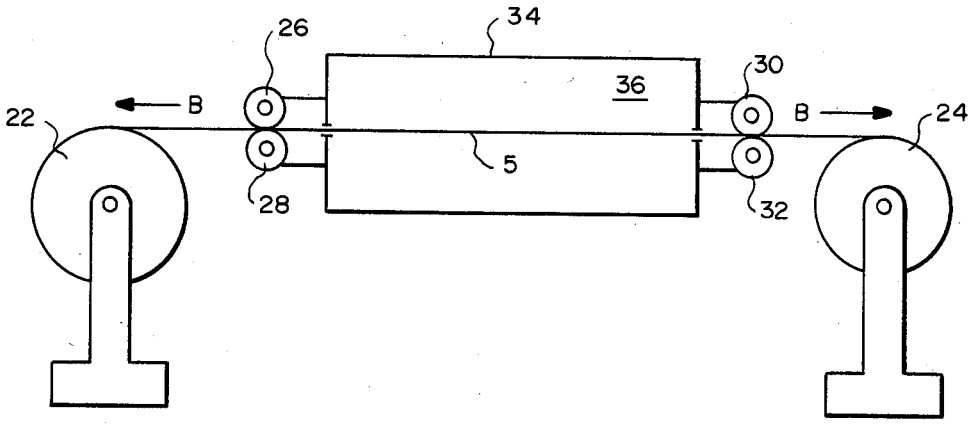

The method of the present invention will be described in more detail hereinafter in conjunction with the drawings wherein:

FIG. 1 schematically illustrates one arrangement for carrying out the method of the present invention; and FIG. 2 schematically illustrates another arrangement for carrying out the method of the present invention.

Referring now to the drawings, attention is first directed to FIG. 1. FIG. 1 shows in simplest form an apparatus for carrying out the method of the present invention. A continuous strip of cast amorphous metal strip material 5, for example the METGLAS® material referred to previously, is stored on a reel 7. Reel 7 is located within a furnace 10 having a special, non-oxidizing atmosphere 12. Amorphous material 5 is heated in the non-oxidizing atmosphere to prevent oxidation of material 5. This protective atmosphere may be a vacuum, an inert gas such as argon, nitrogen or helium, or a reducing gas such as a mixture of nitrogen and hydrogen. Preferably, the atmosphere is nitrogen.

The first step in the method of the present invention calls for heating the amorphous strip material 5 in the non-oxidizing atmosphere of furnace 10. If the amorphous material on reel 5 is METGLAS® amorphous alloy 2605SC, the material is heated to a temperature of approximately 250° C. If METGLAS® amorphous alloy 2605S-2 is used, the material is heated to a temperature of approximately 300° C. The amorphous material should not be heated above these temperatures; otherwise, the material is too brittle and a sufficient tensile force applied thereto to remove surface imperfections would most likely cause the material to fracture.

After the amorphous metal strip material 5 has been heated to the desired temperature, it is then removed from the furnace by winding it about a reel 14. Reel 14 is located outside of the furnace and is preferably at room temperature. In the preferred method, it is important that strip material 5 be wound about reel 14 so that the material is not subjected to a jerking or other irregular motion that might cause the material to break.

As the cast amorphous material 5 is wound from reel 7 to reel 14, it passes through a pair of guide rollers 16 and 18. Also, as the material is wound onto reel 14 it is subjected to a tensile force in the direction of arrow A. The strip material 5 is subjected to this tensile force by means of a frictioning device 20, which is not shown in any detail as such devices are well known in the art. The tensile force applied to material is between 30 mega-Pascals and 60 mega-Pascals (mPa) (1 mPa=145 psi). The preferred tensile force applied to the material is 50 mPa. By winding the material under tension as it cools from its heated state, surface imperfections or the effects of elastic buckling in the material are removed.

A stacked core constructed from cast amorphous metal strip material treated in accordance with the method of the present invention will have improved true watt losses and exciting power requirements as compared to a core made from untreated amorphous strip material.

FIG. 2 illustrates an alternate arrangement for carrying out the thermal flattening method of the present invention. In FIG. 2, a continuous strip of cast amorphous strip material 5 is wound from reel 22 onto reel 24 through roller pairs 26 and 28, and 30 and 32. As the material is wound onto reel 24, it is subjected to a tensile force in the direction of arrows B. Also, as the material is being wound, it passes through a furnace 34 having a special, non-oxidizing atmosphere 36. As noted, this atmosphere is preferably nitrogen.

The furnace is heated to a temperature of between 250° C. and 300° C., depending upon the particular amorphous alloy used. A tensile force is applied to the material in the range of 30 mPa to 60 mPa. Preferably, the tensile force applied to the strip material is 50 mPa for both 2605-SC and 2605S-2 METGLAS amorphous alloy materials.

Although certain specific embodiments of the invention have been described herein in detail, the invention is not to be limited to only such embodiments, but rather only by the appendant claims.

What is claimed is:

1. A method for treating cast amorphous metal strip material, comprising:

heating the amorphous metal strip material to a temperature of approximately 250° C. in a non-oxidizing atmosphere; and applying a tensile force to the amorphous metal strip material to remove surface imperfections therefrom.

2. The method of claim 1 wherein the amorphous metal strip material is heated to a temperature of approximately 300° C.

3. The method of claim 1 or 2 wherein the amorphous metal strip material is subjected to a tensile force of between 30 mPa and 60 mPa.

4. A method of treating cast amorphous metal strip material, comprising:

heating the cast amorphous metal strip to a temperature of at least 250° C. in a non-oxidizing atmosphere;

thereafter removing the cast amorphous metal strip from said non-oxidizing atmosphere; and applying a tensile force thereto as the cast amorphous metal strip material cools to eliminate elastic buckling therefrom.

5. The method of claim 4 wherein the cast amorphous metal strip is heated to a temperature of 300° C.

6. The method of claims 4 or 5 wherein the cast amorphous metal strip is subjected to a tensile force of between 30 mPa and 60 mPa.

7. The method of claim 4 wherein the cast amorphous metal strip is removed from said non-oxidizing atmosphere while said tensile force is simultaneously applied thereto.

8. A method for thermal flattening cast amorphous metal strip material, comprising:

heating a first reel of cast amorphous metal strip to a temperature of approximately 250° C. in a non-oxidizing atmosphere;

thereafter winding the cast amorphous metal strip from said first reel to a second reel located out of said non-oxidizing atmosphere; and applying a tensile force to the cast amorphous metal strip of 50 mPa in a direction parallel to the movement of the cast amorphous metal strip as it is wound onto said second reel.

9. The method of claim 8 wherein the cast amorphous metal strip is heated to a temperature of approximately 300° C.

10. A method for thermal flattening cast amorphous metal strip material, comprising:

winding the cast amorphous metal strip material from a first reel to a second reel;

heating the cast amorphous metal strip material to a temperature of approximately 250° C. in a non-oxidizing atmosphere as it is wound from said first reel to said second reel; and applying a tensile force to the cast amorphous metal strip material of between 30 mPa and 60 mPa in a direction parallel to the movement of the cast amorphous metal strip as it is wound from said first reel to said second reel to remove elastic buckling therefrom.

11. The method of claim 10 wherein the cast amorphous metal strip is heated to a temperature of approximately 300° C.

* * * * *